US007761014B2

(12) United States Patent
Fukushima

(10) Patent No.: US 7,761,014 B2
(45) Date of Patent: Jul. 20, 2010

(54) IMAGE FORMING CARTRIDGE USAGE STORAGE APPARATUS

(75) Inventor: Shoji Fukushima, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 567 days.

(21) Appl. No.: 11/694,832

(22) Filed: Mar. 30, 2007

(65) Prior Publication Data

US 2008/0080875 A1 Apr. 3, 2008

(30) Foreign Application Priority Data

Oct. 2, 2006 (JP) ..... 2006-270473

(51) Int. Cl.
*G03G 15/00* (2006.01)

(52) U.S. Cl. ..... 399/25

(58) Field of Classification Search ..... 399/12, 399/24, 25, 27, 31, 111, 113
See application file for complete search history.

(56) References Cited

U.S. PATENT DOCUMENTS 6,493,519 B2 * 12/2002 Sasame et al. ..... 399/25
6,498,905 B1 * 12/2002 Tsuruya ..... 399/12
7,295,787 B2 * 11/2007 Kikuchi ..... 399/12
2001/0021313 A1 * 9/2001 Maehara ..... 399/12
2004/0196488 A1 * 10/2004 Tanaka et al. ..... 358/1.14
2005/0254834 A1 * 11/2005 Shibui ..... 399/12

FOREIGN PATENT DOCUMENTS

JP 02043570 A * 2/1990
JP 03196065 A * 8/1991
JP 11031107 A * 2/1999
JP 2000172133 A * 6/2000
JP 2003-098912 A 4/2003
JP 2003-271042 A 9/2003
JP 2004125987 A * 4/2004

* cited by examiner

*Primary Examiner*—Robert Beatty
(74) *Attorney, Agent, or Firm*—Sughrue Mion, PLLC

(57) ABSTRACT

An image forming apparatus includes: plural cartridges; a storage unit provided in the respective cartridges; and a writing unit that writes data into the storage unit. The writing unit writes data on usage statuses of one cartridge and the other cartridges into one storage unit provided in the one cartridge.

9 Claims, 8 Drawing Sheets

IMAGE FORMING CARTRIDGE USAGE STORAGE APPARATUS

CROSS-REFERENCE TO RELATED APPLICATIONS

This application is based on and claims priority under 35 USC 119 from Japanese Patent Application No. 2006-270473 filed Oct. 2, 2006.

BACKGROUND

1. Technical Field

The present invention relates to an image forming apparatus.

2. Related Art

As a technique used in an image forming apparatus, there are disclosed use of plural cartridges, storage units provided in the respective cartridges, and a writing unit to write data into these storage units.

SUMMARY

According to an aspect of the invention, there is provided an image forming apparatus including: plural cartridges; a storage unit provided in the respective cartridges; and a writing unit that writes data into the storage unit. The writing unit writes data on usage statuses of one cartridge and the other cartridges into one storage unit provided in the one cartridge.

BRIEF DESCRIPTION OF THE DRAWINGS

Exemplary embodiments of the present invention will be described in detail based on the following figures, wherein.

DETAILED DESCRIPTION

Next, an exemplary embodiment of the present invention will be described based on the drawings.

Figure 1:
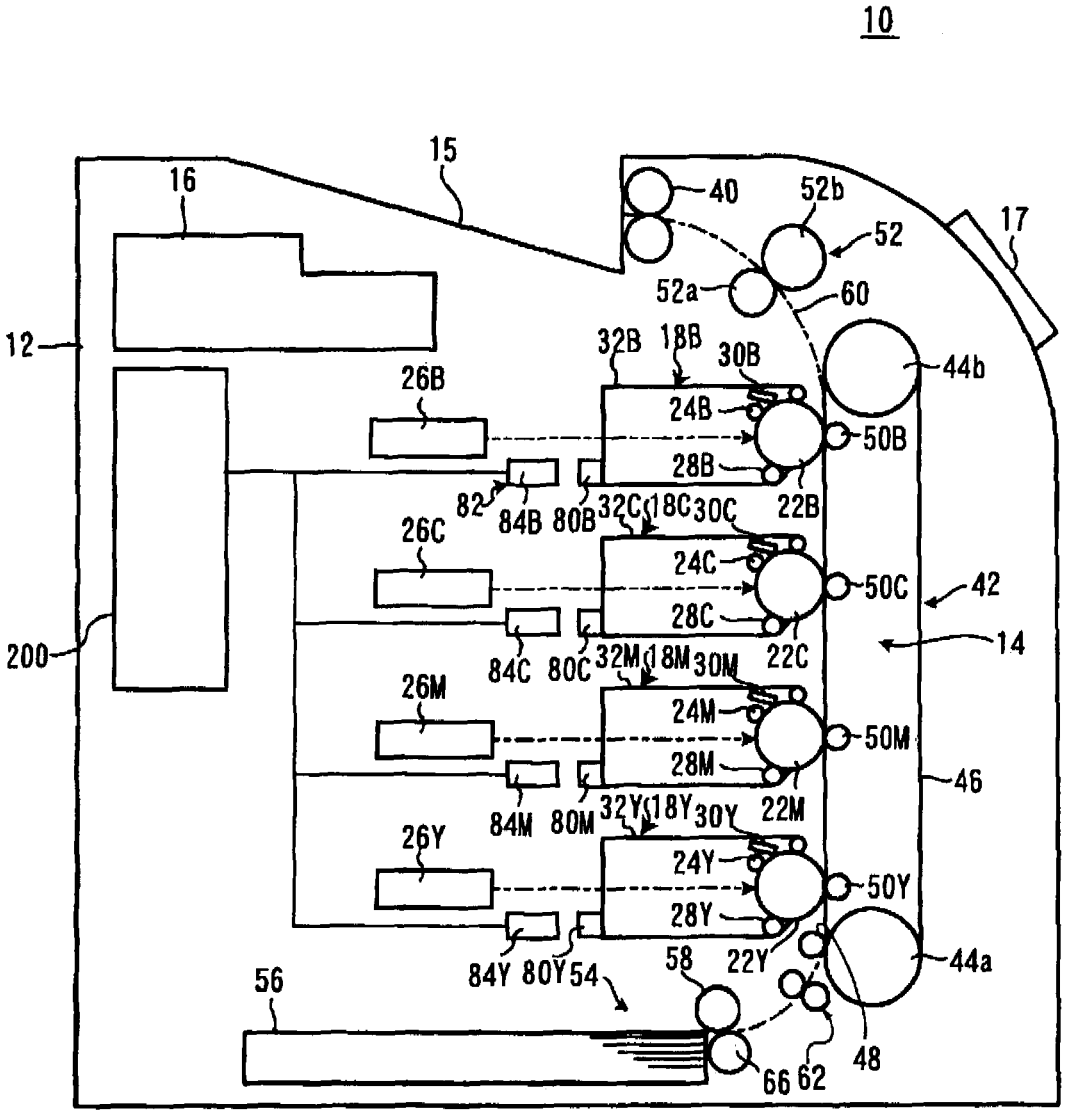
FIG. 1 is a cross-sectional view of a structure of an image forming apparatus according to an exemplary embodiment of the present invention.

FIG. 1 shows an image forming apparatus 10 according to the exemplary embodiment of the present invention. The image forming apparatus 10 has an image forming apparatus main body 12. The image forming apparatus main body 12 includes an image forming part 14, a sheet feeder 54 to feed a sheet to the image forming part 14, a power source unit 16 and a controller 200. Further, a sheet discharge part 15, on which a sheet subjected to image formation is discharged, is provided in an upper part of the image forming apparatus main body 12. Further, a display panel 17 used as a display is attached to the outside of the image forming apparatus main body 12. The display panel 17, having a liquid crystal display device and the like, displays, for an operator, a message informing that, for example, a unit such as a process cartridge 32 to be described later needs to be exchanged with a new one.

The image forming part 14 is an electrophotographic type unit to form a color image. The image forming part 14 includes an image forming part 18Y to form a yellow image using yellow developing material, an image forming part 18M to form a magenta image using magenta developing material, an image forming part 18C to form a cyan image using cyan developing material, and an image forming part 18B to form a black image using black developing material. These image forming parts, namely the image forming part 18Y, the image forming part 18M, the image forming part 18C and the image forming part 18B, are provided along a conveyance belt 46 to be described later, in this order, from a lower position in the gravity direction as the upstream side of sheet conveyance direction.

As the image forming parts 18Y, 18M, 18C and 18B have the same structure although the colors of images they form are different, the structure will be described below as an image forming part 18. The image forming part 18 has a photoreceptor 22, used as an image holder, a charger 24 which has a charging roller to uniformly charge the photoreceptor 22 and which is used as a charging unit, a light writer 26 used as a latent image writing unit to optically write a latent image on the photoreceptor 22, a developing unit 28 to develop the latent image written on the photoreceptor 22 with developing material thereby forming a developing material image used as a visible image, a transfer roller 50 to transfer the developing material image formed on the photoreceptor 22 onto a sheet, and a cleaner 30 used as a developing material removing unit to remove developing material remaining on the surface of the photoreceptor 22 after the transfer with the transfer roller 50. The light writer 26 having a laser exposure device emits a laser beam thereby writes a latent image on the photoreceptor 22.

Among the elements of the image forming part 18, the photoreceptor 22, the charger 24, the developing unit 28 and the cleaner 30 are integrated as the process cartridge 32 used as a cartridge, and removably attached in the image forming apparatus main body 12.

The process cartridge 32 is provided with a communication tag 80. A communication unit 82 which is used as a writing unit and which performs communication with the communication tag 80 is provided on the image forming apparatus main body 12 side. The communication unit 82 has four antennas 84Y, 84M, 84C and 84B used as communication members. The antennas 84Y, 84M, 84C and 84B are provided in positions respectively radio-communicable with the communication tags 80Y, 80M, 80C and 80B. Further, the antennas 84Y, 84M, 84C and 84B are respectively connected to the controller 200. In the present exemplary embodiment, radio communication is performed between the communication tags 80Y, 80M, 80C and 80B, and the antennas 84Y, 84M, 84C and 84B, however, it may be arranged such that the antennas to perform radio communication are replaced with communication members to perform cable communication, these communication members are connected to the communication tags 80Y, 80M, 80C and 80B via communication cables, and communication is performed using the communication cables.

The transfer rollers 50Y, 50M, 50C and 50B are integrated, together with the other members, as a transfer unit 42, and the transfer unit 42 is removable from the image forming apparatus main body 12. The transfer unit 42 has two support rollers 44*a* and 44*b*, the conveyance belt 46 to convey a sheet and an attachment roller 48, in addition to the transfer rollers 50Y, 50M, 50C and 50B. The support roller 44*a*, which is used as a driving roller to drive the conveyance belt 46, is connected to a driving source (not shown) such as a motor. The attachment roller 48 is used as an electrostatic attachment unit to attach the sheet to the conveyance belt 46.

Developing material images, formed on the photoreceptors 22Y, 22M, 22C and 22B, are transferred with the respective transfer rollers 50Y, 50M, 50C and 50B onto a sheet being conveyed with the conveyance belt 46. Thus a full-color developing material image is formed by overlaying the yellow, magenta, cyan and black color developing material images on the sheet.

A fixing device 52 to fix the developing material image, transferred onto a sheet, to the sheet, is provided in an upper part of the image forming apparatus main body 12. The fixing device 52 having a heating roller 52*a* and a pressure roller 52*b* fixes the developing material image to the sheet, passing between the heating roller 52*a* and the pressure roller 52*b*, with heat and pressure.

The sheet feeder 54 has a sheet feed cassette 56 used as a sheet container, a feed roller 58 to feed a sheet from the sheet feed cassette 56 toward the image forming part 14, and a retard roller 66 used as a separating member.

The sheet feed cassette 56 is removably attached to the image forming apparatus main body 12. Sheets including normal paper sheets, OHP sheets and the like, are stacked in the sheet feed cassette 56. The retard roller 66 is provided in press-contact with the feed roller 58, forming a contact portion with respect to the feed roller 58. The retard roller 66 retards a sheet fed from the sheet feed cassette 56 at this contact portion, thereby separates the sheet, thus prevents sheet multi-feeding.

Further, a conveyance path 60 to convey a sheet fed from the sheet feeder 54 to the sheet discharge part 15 is provided inside the image forming apparatus main body 12. Registration rollers 62, the transfer unit 42, the fixing device 52 and the discharge rollers 40 are provided, along the conveyance path 60, sequentially from the upstream side of the sheet conveyance direction. The discharge rollers 40 discharge a sheet conveyed from the fixing device 52 to the sheet discharge part 15.

Figure 2:
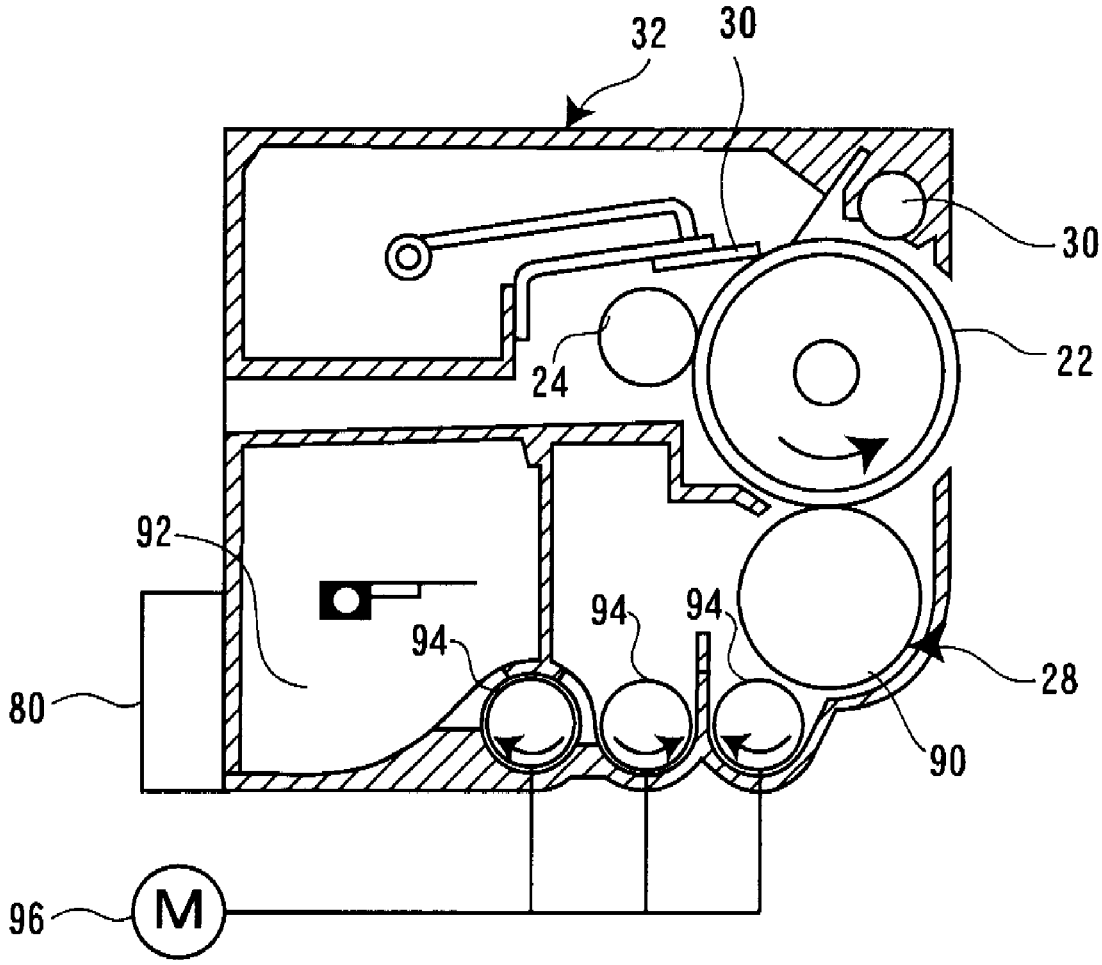
FIG. 2 is a cross-sectional view showing a cartridge used in the image forming apparatus according to the exemplary embodiment of the present invention.

FIG. 2 shows the details of the above-described process cartridge 32. As described above, the process cartridge 32 has the photoreceptor 22, the charger 24, the developing unit 28 and the cleaner 30. The developing unit 28 has a developing roller 90 used as a developing material holder. The developing material roller 90 holding developing material on its surface supplies the developing material to the surface of the photoreceptor 22, to develop a latent image formed on the surface of the photoreceptor 22. Further, the developing unit 28 has a developing material chamber 92 used as developing material container to contain developing material, and dispensers 94 used as a developing material supply units to supply the developing material contained in the developing material chamber 92 to the developing roller 90.

The dispensers 94 are connected to a driving source 96 such as a motor attached on the image forming apparatus main body 12 side. The dispensers 94 are rotated by driving transmitted from the driving source 96, to supply developing material to the developing roller 90. The process cartridges 32Y, 32M, 32C and 32B are connected to driving sources 96Y, 96M, 96C and 96B. These driving sources drive the dispensers 94 of the respective process cartridges 32Y, 32M, 32C and 32B.

Figure 3:
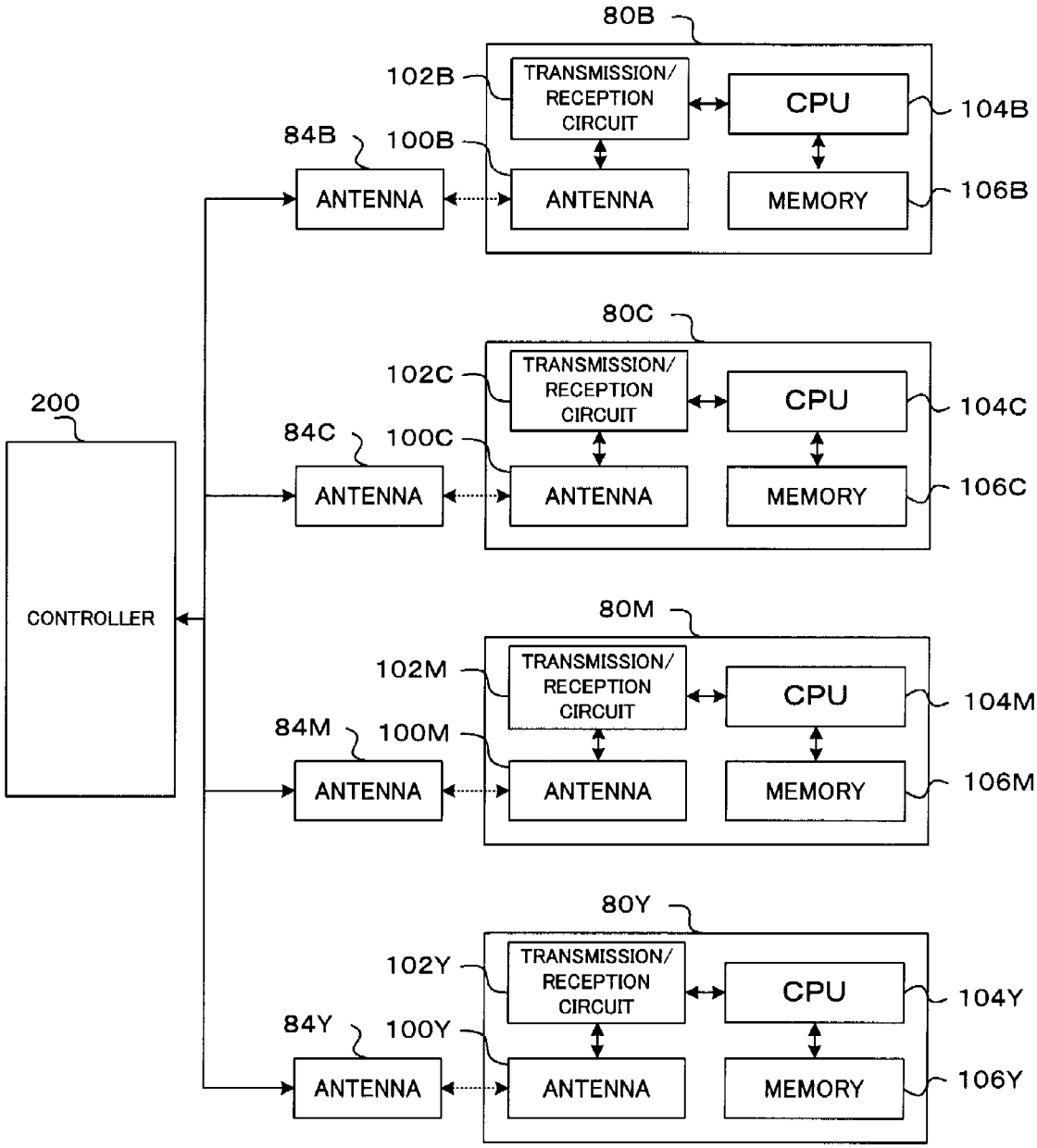
FIG. 3 is a block diagram showing a configuration of a communication tag used in the image forming apparatus according to the exemplary embodiment of the present invention.

FIG. 3 is a block diagram showing the details of the communication tag 80. The communication tag 80 has an antenna 100, a transmission/reception circuit 102, a CPU 104 and a memory 106 used as a storage unit. The antenna 100 performs radio communication with the antenna 84 connected to the controller 200 provided on the image forming apparatus main body 12 side, receives an information signal outputted from the antenna 100 and transmits an information signal to the antenna 100. The CPU 104 inputs the signal received with the antenna 100 via the transmission/reception circuit 102, and transmits an information signal to the antenna 100 via the transmission/reception circuit 102.

The memory 106 is used as a storage unit, to hold data on usage status of the process cartridge 32, a manufacture's serial number of the process cartridge 32, a lot number, and the like. The information on the usage status of the process cartridge 32 means information on actual driving time of the process cartridge 32 or the like. For example, time in which the dispensers 94 (see FIG. 2) are actually rotated is given as the data on the usage status of the process cartridge 32. As the time of actual rotation of the dispensers 94, the number of driving pulses of the driving source 96 (see FIG. 2) or the like is stored. In the present exemplary embodiment, the number of pulses supplied to the driving source 96 before the start of use of the process cartridge 32 is stored in the memory 106. The number of pulses stored in the memory 106 before the start of use of the process cartridge 32 may be read from the controller 200 via the antenna 100 and the antenna 84, and may be used in the controller 200.

Figure 4:
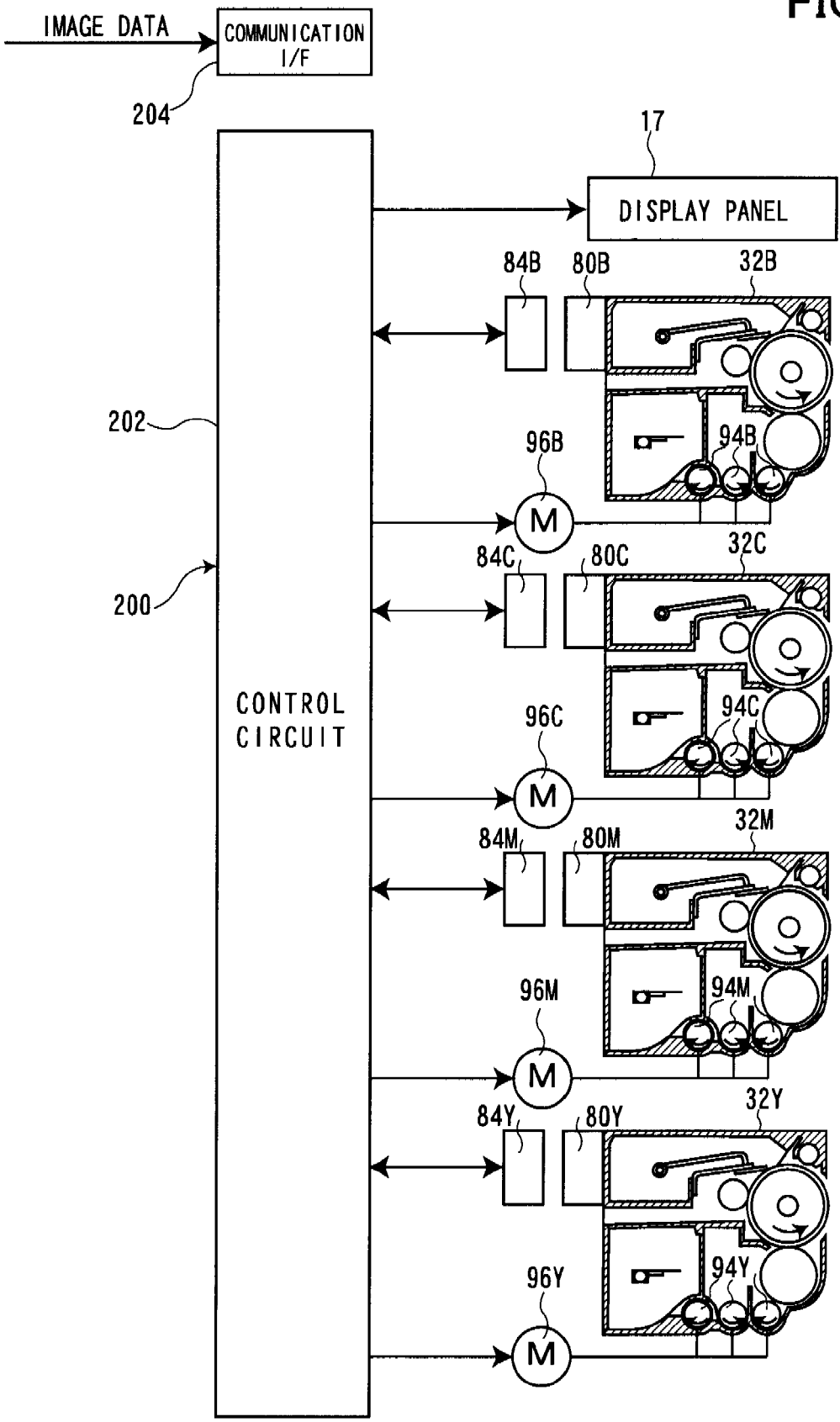
FIG. 4 is a block diagram showing a controller used in the image forming apparatus according to the exemplary embodiment of the present invention.

FIG. 4 is a block diagram showing the details of the controller 200. The controller 200 has a control circuit 202 having a CPU and a transmission/reception circuit. The control circuit 202 inputs signals transmitted from the antennas 100Y, 100M, 100C and 100B and received with the antennas 84Y, 84M, 84C and 84B. Further, the control circuit 202 inputs image data via a communication interface 204. Further, the display panel 17 and the driving sources 96Y, 96M, 96C and 96B are controlled in accordance with outputs from the control circuit 202. The control circuit 202 transmits information on usage statuses of the process cartridges 32Y, 32M, 32C and 32B via the antennas 84Y, 84M, 84C and 84B and the antennas 100Y, 100M, 100C and 100B (see FIG. 3), so as to store the information into the memories 106Y, 106M, 106C and 106B (see FIG. 3). As described above, in the present exemplary embodiment, as information on usage statuses of the respective process cartridges 32, the number of pulses of the driving source 96 indicating the driving time of the dispensers 94 is used. That is, the controller 200 transmits and stores the number of pulses of the driving sources 96Y, 96M, 96*c* and 96B into the memories 106Y, 106M, 106C and 106B.

Figure 5:
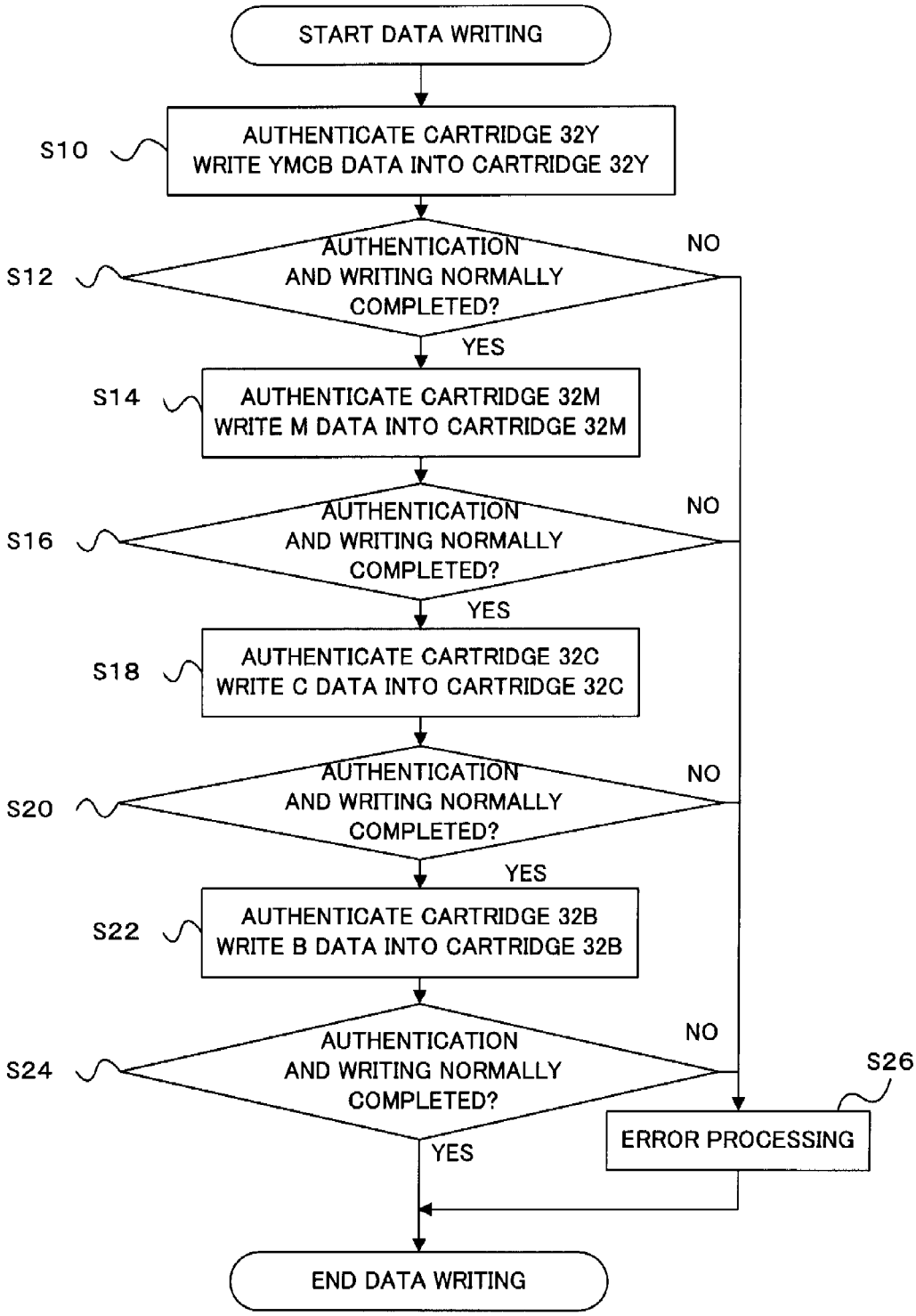
FIG. 5 is a flowchart showing a control flow in the image forming apparatus according to the exemplary embodiment of the present invention upon data writing into a storage unit.

FIG. 5 is a flowchart showing a control flow by the controller 200 upon writing of data on usage statuses of the process cartridges 32Y, 32M, 32C and 32B into the memories 106Y, 106M, 106C and 106B. In the control flow, the data on usage statuses of the respective process cartridges 32 is stored into the respective memories 106 upon completion of image forming operation (job).

When the data writing control flow is started upon completion of image forming operation, at step S10, the control circuit 202 performs authentication of the process cartridge 32Y, then writes information on usage statuses of all the process cartridges 32Y, 32M, 32C and 32B into the memory 106Y provided in the process cartridge 32Y. That is, the amounts of pulse supply from the control circuit 202 to the driving sources 96Y, 96M, 96C and 96B, for the job completed immediately before the start of the data writing flow, are stored into the memory 106Y.

Next, at step S12, it is checked whether or not the authentication of the process cartridge 32Y and the writing into the memory 106Y have been normally completed. Then at step S14, the control circuit 202 performs authentication of the process cartridge 32M, then writes information on usage status of the process cartridge 32M into the memory 106M provided in the process cartridge 32M. That is, the amount of pulse supply from the control circuit 202 to the driving source 96M, for the job completed immediately before the start of the data writing, is stored into the memory 106M.

Next, at step S16, it is checked whether or not the authentication of the process cartridge 32M and the writing into the memory 106M have been normally completed. Then at step S18, the control circuit 202 performs authentication of the process cartridge 32C, then writes the amount of pulse supply from the control circuit 202 to the driving source 96C, for the job completed immediately before the start of the data wiring, into the memory 106C.

Next, at step S20, it is checked whether or not the authentication of the process cartridge 32C and the writing into the memory 106C have been normally completed. Then at step S22, the control circuit 202 performs authentication of the process cartridge 32B, then writes the amount of pulse supply from the control circuit 202 to the driving source 96B, for the job completed immediately before the start of the data writing, into the memory 106B.

Next, at step S24, it is checked whether or not the authentication of the process cartridge 32B and the writing into the memory 106B have been normally completed. If YES, the data writing flow ends.

If it is determined at step S12, S16, S20 or step S24 that the authentication of the process cartridge 32 and/or the writing into the memory 106 has not been normally completed, the control circuit 202 performs predetermined error processing at step S26, and the data writing flow ends.

In the present exemplary embodiment, the data writing is first performed on the memory 106, and the data on usage statuses of all the process cartridges 32Y, 32M, 32C and 32B is written into the memory 106Y. However, it may be arranged such that one of the other memories 106M, 106C and 106B is selected in place of the memory 106Y in the initial data writing, and the data on usage statuses of all the process cartridges 32Y, 32M, 32C and 32B is written into the selected memory.

Further, one of the memories 106Y, 106M, 106C and 106B, different from that subjected to writing of data on usage statuses of all the process cartridges 32Y, 32M, 32C and 32B upon previous writing, may be selected upon current writing of data on usage statuses of all the process cartridges.

Figure 6:
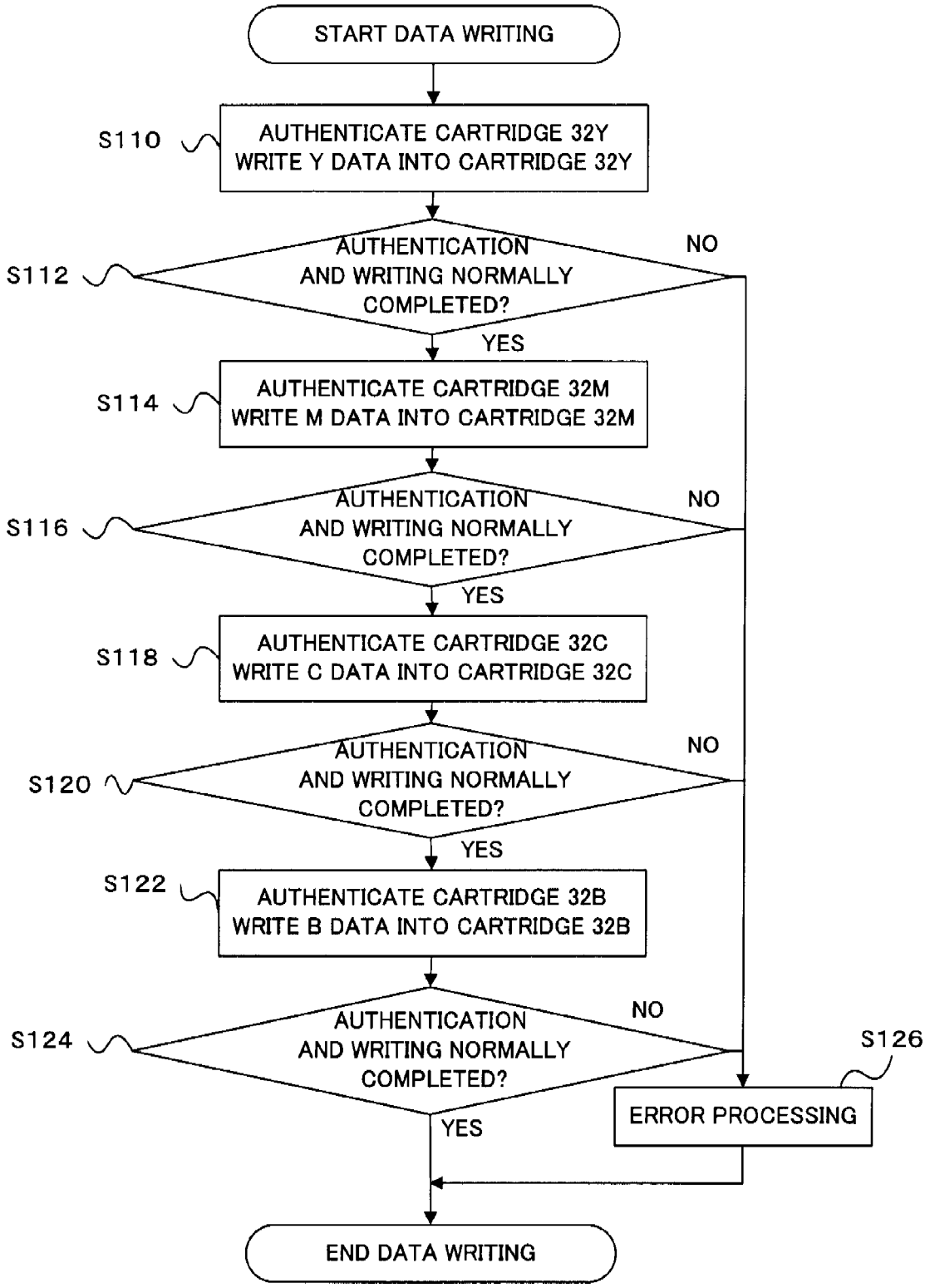
FIG. 6 is a flowchart showing a comparative example of the control flow upon data writing into the storage unit.

FIG. 6 is a flowchart showing a comparative example of the control flow in writing of data on usage statuses of the process cartridges 32Y, 32M, 32C and 32B into the memories 106Y, 106M, 106C and 106B. In the control flow according to the above-described exemplary embodiment, at step S12, the information on usage statuses of all the process cartridges 32Y, 32M, 32C and 32B is written into the memory 106Y provided in the process cartridge 32Y, however, in this example, at step S110, information on the usage status of only the process cartridge 32Y is written into the memory 106Y provided in the process cartridge 32Y. The control from step S112 to step S126 is the same as that from step S12 to step S26 in the control flow (see FIG. 5) according to the above-described exemplary embodiment.

In the above-described exemplary embodiment, as the data written into the memories 106M, 106C and 106B is already written into the memory 106Y at step S10, even an error occurs in writing into the memories 10M, 106C and 106B due to shut off of the power source or the like at step S14 and the subsequent steps, the data in the memory 106Y may be used as backup data. On the other hand, in the control flow of this comparative example, when an error occurs at step S14 and the subsequent steps, there is no backup data, and data to be written into the memories 106M, 106C and 106B is lost. In this case, since the actual rotation of the dispensers 94, i.e., the use of process cartridge 32, is not written into the memory 106, control regarding apparatus life, for example, to display a message to prompt exchange of process cartridge on the display panel 17, cannot be excellently performed based on the data stored in the memory 106.

It seems that time required for writing data on the process cartridges 32Y, 32M, 32C and 32B into the memories 106Y, 106M, 106C and 106B from step S110 to step S124 in the comparative example is not different from that required for writing data on the process cartridges 32Y, 32M, 32C and 32B into the memory 106Y at step S10 in the above-described exemplary embodiment because the same data is written in both control flows. However, the writing time at step S10 of the control flow according to the exemplary embodiment is shorter than that in the comparative example because in the exemplary embodiment, the authentication of the respective process cartridges 32M, 32C and 32B is not required.

Figure 7:
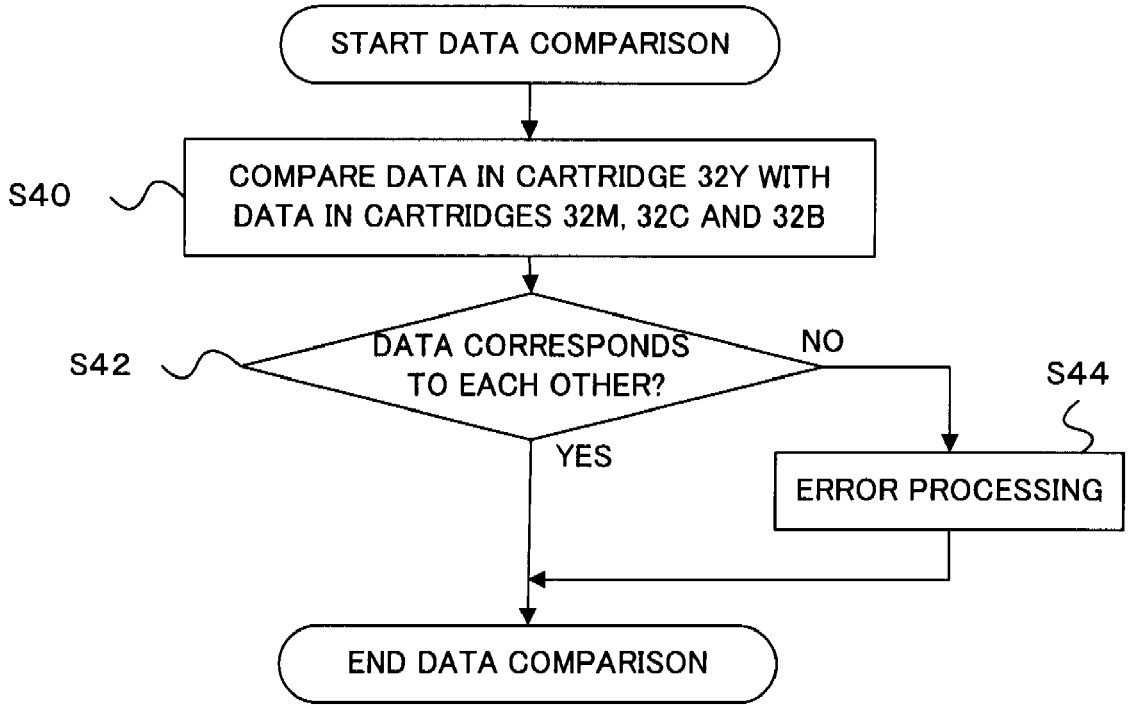
FIG. 7 is a flowchart showing a first control flow in the image forming apparatus according to the exemplary embodiment of the present invention upon comparison of data written in the storage units.

FIG. 7 is a flowchart showing a first control flow by the controller 200 upon comparison of data written in the memories 106M, 106C and 106B. When the data comparison control flow is started, at step S40, the controller 200 compares the data on the usage statuses of the process cartridges 32M, 32C and 32B stored in the memory 106Y (backup data) with the data respectively stored in the process cartridges 32M, 32C and 32B on the usage statuses of the respective cartridges 32.

Then, if it is determined at step S42 that the data corresponds with each other, the comparison processing ends. On the other hand, if it is determined at step S42 that the data does not correspond with each other, predetermined error processing is performed at step S44, and the comparison processing ends.

As an example of discrepancy, when the counter data of the memory 106 of one cartridge 32 is smaller than that of the backup data, it is determined as a result of comparison that the data does not correspond with each other. When the counter data of the process cartridge 32M stored as backup data in the memory 106Y is 100 while the counter data of the process cartridge 32M stored in the memory 106M is 90, the data does not correspond with each other. In this case, there is a probability that some of the data has been lost on the memory 106M side of the cartridge 32M or that the backup data has been changed on the memory 106Y side. Further, as another example, when the counter data of the memory 106 of one cartridge 32 is larger than that of the backup data, the data does not correspond with each other. When the counter data of the backup data on the memory 106Y is 100, while the counter data on the memory 106M is 110, the data does not correspond with each other. In this case, there is a probability that the backup data or the data on the memory 106M side has been changed.

As the error processing at step S44, a message indicating the occurrence of error may be displayed on the display panel 17, or the image forming function of the image forming apparatus 10 may be stopped. Further, it may be arranged such that the image forming function is stopped only when it is determined, based on the degree of the difference between the backup data and the data in the memory 106 of one cartridge as well as the frequency of occurrence of discrepancy or the like, that such error will seriously influence an image to be formed or control regarding the lives of the respective cartridges 32.

Further, when an error has occurred due to writing error (lost of data) to the memories 106M, 106C and/or 106B, the backup data stored in the memory 106Y may be written into the memories 106M, 106C and/or 106B as error processing.

Figure 8:
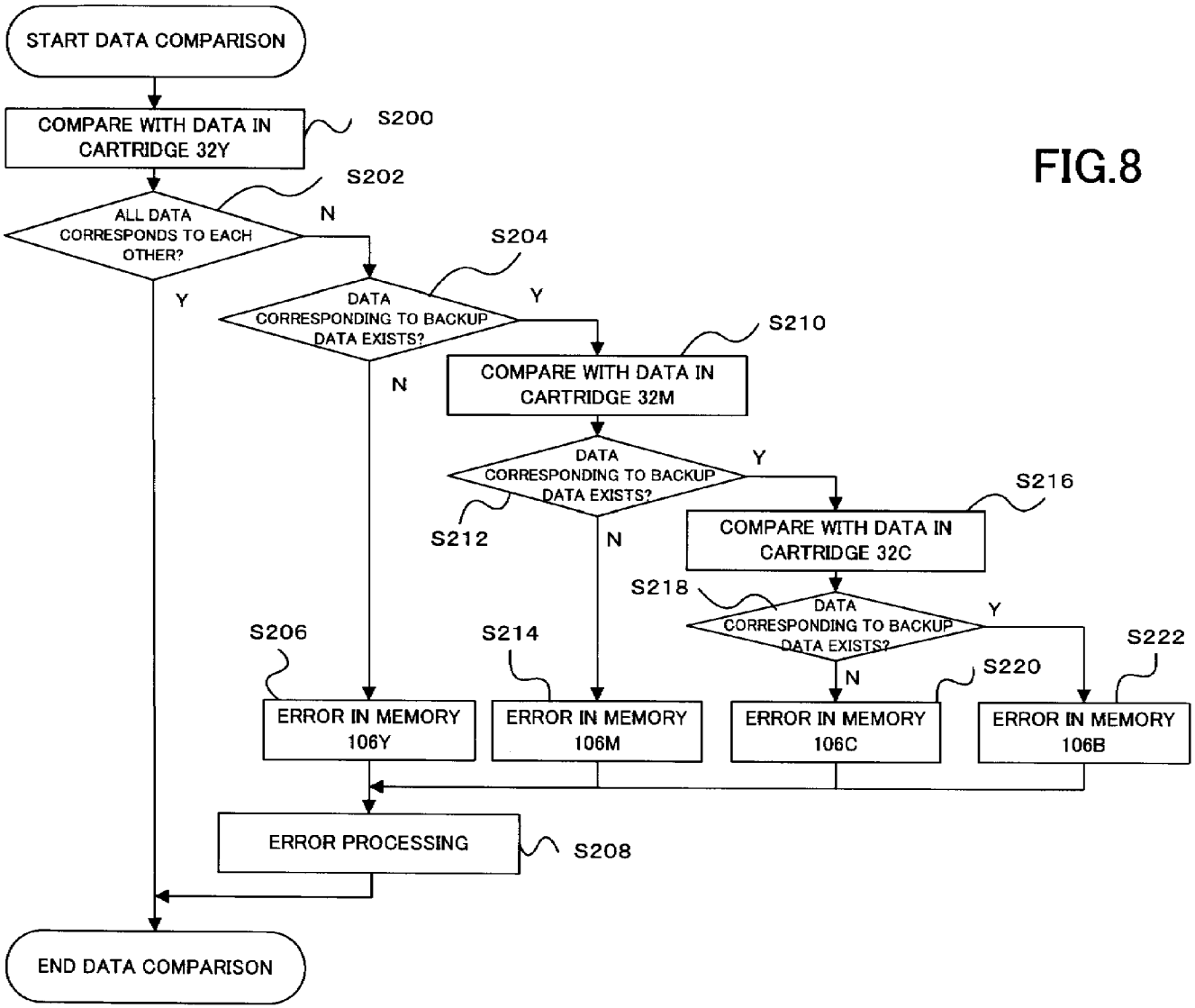
FIG. 8 is a flowchart showing a second control flow in the image forming apparatus according to the exemplary embodiment of the present invention upon comparison of data written in the storage units.

FIG. 8 is a flowchart showing a second control flow by the controller 200 upon comparison of data written in the memories 106M, 106C and 106B. In the first data comparison control flow, the backup data is stored in the memory 106Y, and data comparison is performed using the backup data (see FIG. 7). On the other hand, in the second control flow, the backup data is stored in all the memories 106Y, 106M, 106C and 106B, and data comparison is performed using this backup data. That is, the memory 106Y holds backup data for the memories 106M, 106C and 106B; the memory 106M holds backup data for the memories 106Y, 106C and 106B; the memory 106C holds backup data for the memories 106Y, 106M and 106B; and the memory 106B holds backup data for the memories 106Y, 106M and 106C. The data comparison is performed using these data.

In the exemplary embodiment, when the second data comparison control flow is started, at step S200, the controller 200 compares the data on usage statuses of the process cartridges 32M, 32C and 32B (backup data) stored in the memory 106Y with the data on usage statuses of the respective process cartridges 32, stored in the respective process cartridges 32M, 32C and 32B.

Next, at step S202, it is determined whether or not the backup data on usage statuses of the process cartridges 32M, 32C and 32B stored in the memory 106Y correspond with all the data on usage statuses of the process cartridges 32 respectively stored in the process cartridges 32M, 32C and 32B. It is determined that the backup data correspond with all the data stored in the respective process cartridges 32, the data comparison ends.

On the other hand, if it is determined at step 202 that there is data which does not correspond with the backup data, the process proceeds to step S204. At step S204, it is determined whether or not there is at least one data piece, which corresponds with the backup data on usage statuses of the process cartridges 32M, 32C and 32B stored in the memory 106Y, among the data on usage statuses of the process cartridges 32 respectively stored in the process cartridges 32M, 32C and 32B. If there is no data which corresponds with the backup data, it is determined at step S206 that an error occurs in writing to the memory 106Y due to e.g. failure of communication between the antenna 84Y and the antenna 100Y. At step S208, predetermined error processing is performed, and the data comparison ends.

On the other hand, if it is determined at step S204 that there is data which corresponds with the backup data stored in the memory 106Y, the process proceeds to step S210. At step S210, the control circuit 202 compares the backup data for the process cartridges 32Y, 32C and 32B stored in the memory 106M provided in the magenta cartridge 32M with the information on the cartridges respectively stored in the memories 106Y, 106C and 106B.

Next, at step S210, the data on usage statuses of the process cartridges 32 respectively stored in the process cartridges 32Y, 32C and 32B is compared with the backup data for the process cartridges 32Y, 32C and 32B stored in the memory 106M.

Next, at step S212, it is determined whether or not there is at least one data, which corresponds with the backup data on usage statuses of the process cartridges 32Y, 32C and 32B stored in the memory 106M, among the data on usage statuses of the process cartridges 32 respectively stored in the process cartridges 32Y, 32C and 32B. If there is no data which corresponds with the backup data, it is determined at step S214 that an error occurs in writing to the memory 106M due to e.g. failure of communication between the antenna 84M and the antenna 100M. At step S208, predetermined error processing is performed, and the data comparison ends.

On the other hand, if it is determined at step S212 that there is data which corresponds with the backup data stored in the memory 106M, the process proceeds to step S216. At step S216, the control circuit 202 compares the backup data for the process cartridges 32Y, 32M and 32B stored in the memory 106C provided in the cyan cartridge 32C with the information on the cartridges respectively stored in the memories 106Y, 106M and 106B.

Next, at step S216, it is determined whether or not there is at least one data piece, which corresponds with the backup data on usage statuses of the process cartridges 32Y, 32M and 32B stored in the memory 106C, among the data on usage statuses of the process cartridges 32 respectively stored in the process cartridges 32Y, 32M and 32B. If there is no data which corresponds with the backup data, it is determined at step S220 that an error occurs in writing to the memory 106C. At step S208, predetermined error processing is performed, and the data comparison ends.

On the other hand, if it is determined at step S218 that there is data which corresponds with the backup data, it is determined at step S222 that an error occurs in writing to the memory 106B. At step S208, predetermined error processing is performed, and the data comparison ends.

As described above, the present invention is applicable to an image forming apparatus having plural cartridges such as process cartridges, such as a copier, a facsimile machine, a printer or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a plurality of cartridges;

a storage unit provided in the respective cartridges; and a writing unit that writes data into the storage unit, the writing unit writing data on usage statuses of one cartridge and the other cartridges into one storage unit provided in the one cartridge, wherein the writing unit writes the data on usage statuses of one cartridge and the other cartridges into a storage unit of another cartridge other than the one storage unit where the data has been previously written.

2. The image forming apparatus according to claim 1, wherein the writing unit writes the data into the storage unit after completion of an image forming operation.

3. The image forming apparatus according to claim 1, wherein the writing unit writes the data on usage statuses, written into the one storage unit of the one cartridge, into a storage unit of another cartridge.

4. An image forming apparatus, comprising a plurality of cartridges;

a storage unit provided in the respective cartridges; and a writing unit that writes data into the storage unit, the writing unit writing data on usage statuses of one cartridge and the other cartridges into one storage unit provided in the one cartridge, wherein, upon occurrence of an error in data writing into one storage unit, the writing unit writes backup data, stored in another storage unit, into the storage unit where the error has occurred.

5. The image forming apparatus according to claim 4, further comprising a comparison unit that compares data stored in one of the storage units with data stored in another storage unit.

6. The image forming apparatus according to claim 5, further comprising a determination unit that determines whether or not an error has occurred in data writing into the one storage unit by the writing unit based on a result of comparison by the comparison unit.

7. The image forming apparatus according to claim 6, wherein when data previously stored in one storage unit does not correspond with data subsequently stored in another storage unit, the determination unit determines an error has occurred in data writing into the one storage unit.

8. The image forming apparatus according to claim 6, when data stored in one storage unit does not correspond with data stored in all the other storage units, the determination unit determines that an error has occurred in data writing into the one storage unit.

9. The image forming apparatus according to claim 5, further comprising a controller that prohibits an image forming operation based on the result of comparison by the comparison unit.

* * * * *